United States Patent [19]

Rinehimer et al.

[11] 3,973,506

[45] Aug. 10, 1976

[54] METHOD AND APPARATUS FOR MAKING SHIRT CUFFS

[75] Inventors: Elwood Rinehimer, Wapwallopen; Donald M. Walters, Lehighton; Kenneth L. Jarrett, Sr., Mertztown, all of Pa.

[73] Assignee: Eagle Shirtmakers, Inc., New York, N.Y.

[22] Filed: Dec. 11, 1974

[21] Appl. No.: 531,803

Related U.S. Application Data

[62] Division of Ser. No. 357,827, May 7, 1973, Pat. No. 3,884,166.

[52] U.S. Cl. ..... 112/130; 112/121.29; 112/262

[51] Int. Cl.[2] ..... D05B 19/00; D05B 37/04

[58] Field of Search ..... 112/130, 122, 252, 214, 112/121.11, 121.27, 121.29, 262; 83/367, 365, 371

[56] References Cited

UNITED STATES PATENTS

| | | | |
|---|---|---|---|
| 2,521,360 | 9/1950 | Gerstein | 112/214 |
| 3,670,679 | 6/1972 | Campbell | 112/121.27 X |
| 3,780,682 | 12/1973 | Frost | 112/121.27 X |
| 3,785,307 | 1/1974 | Hunter, Jr. et al. | 112/121.27 |
| 3,796,117 | 3/1974 | Mukai et al. | 83/367 X |

*Primary Examiner*—H. Hampton Hunter
*Attorney, Agent, or Firm*—Imirie, Smiley & Linn

[57] ABSTRACT

A method and apparatus for producing a multi-ply fabric or clothing material unit such as a shirt cuff or the like. A continuous strip of material is fed to a stitching head, and precut fabric pieces are placed on the strip at a positioning station in end to end relation to each other. The continuous strip conveys the fabric pieces through the apparatus. A side edge of each fabric piece is folded around a side edge of the strip by a folder and the folded piece is stitched to the strip by the stitching head. The continuous strip can be fed and stitched continuously or intermittently. The strip with the pieces stitched to it is fed to a cutter where the strip is cut into individual pieces along the ends of the fabric pieces. The cutter is actuated in response to sensing an end edge of a fabric piece sewn to the strip. Feed of the strip at the cutter is arrested by a blocking mechanism including a slip clutch, ratchet wheel, and pawl which blocks the feed so cutting occurs while the strip is stationary. Resumption of feeding at the cutter is prevented until after the severed piece is moved from a position in the path of travel of the strip. To prevent jamming at the cutter, the control arrangement includes two sensing devices for sensing the proper feeding of the strip. Failure of either sensing device to operate prevents actuation of the cutter thereby avoiding the danger of severing the strip except when the feed is operating properly. A unique feed roller arrangement grips the strip and clothing material pieces across the width of the strip to ensure proper tensioning and feeding at the stitching head.

11 Claims, 10 Drawing Figures

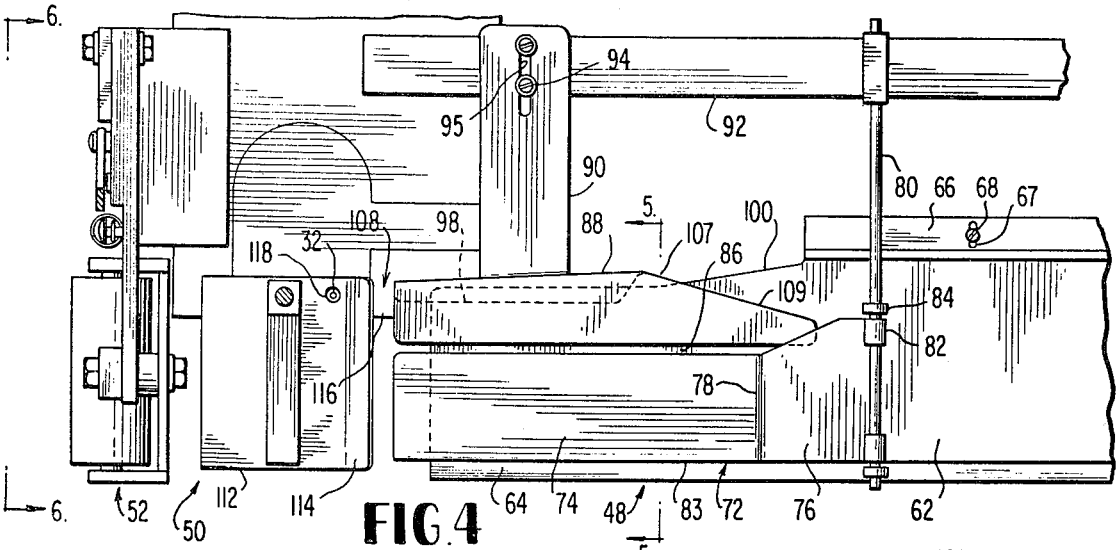
FIG. 4
FIG. 9
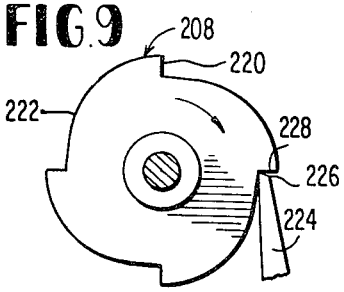
FIG. 8
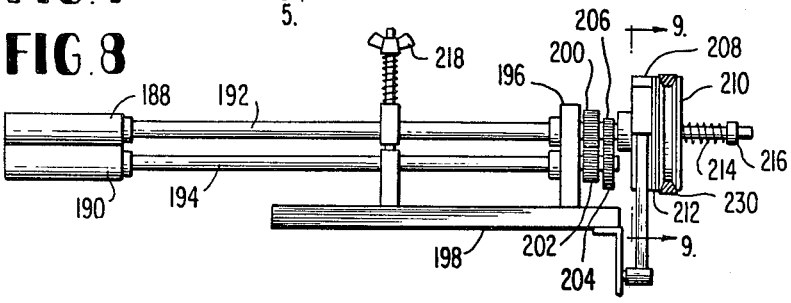
FIG. 6
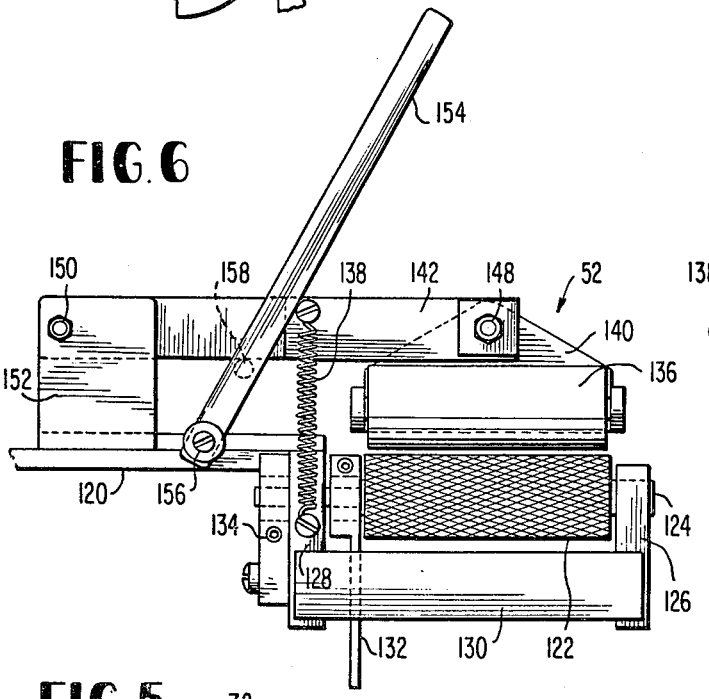
FIG. 7
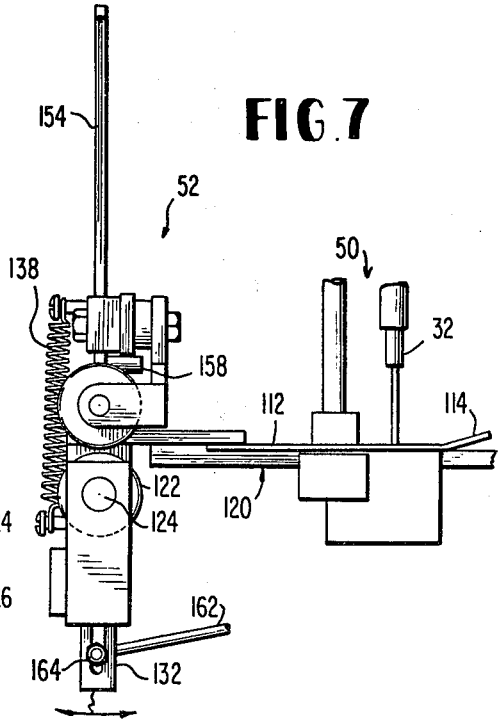
FIG. 5
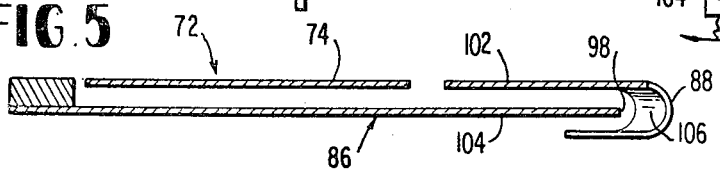

METHOD AND APPARATUS FOR MAKING SHIRT CUFFS

This is a division of application Ser. No. 357,827, filed May 7, 1973, Now U.S. Pat. No. 3,884,166.

BACKGROUND OF THE INVENTION

This invention relates to a method and apparatus for rapidly producing lined shirt cuffs and other multi-ply fabric products.

In the production of sleeve cuffs for shirts, a fabric lining or stiffener is first stitched to a precut piece of shirt fabric and a second precut piece of shirt fabric is subsequently stitched over the previously sewn lining and fabric. This provides a stiffener for the shirt cuff which is not visible when the cuff is finished and assists retaining the shape of the cuff, which while flexible, is sufficiently rigid to present a neat uncreased appearance.

In the past, sleeve cuffs have been made from three separate pieces of material, which are precut generally rectangular pieces of a desired size. Of these pieces, one is the lining and the other two are shirt fabric and cover the inner and outer faces of the finished cuff. In the past, such cuffs have been formed by hand in a series of individual operations, the first being to place a piece of the shirt fabric on the lining, fold an edge of the shirt fabric around a side edge of the lining, and then feed the lining and fabric by hand through a sewing machine to stitch the fabric to the lining along the folded edge. Subsequently, the second piece of shirt fabric is aligned with the lining and first piece and is fed by hand through the sewing machine to stitch the fabrics together.

During the initial operation of stitching the first piece of shirt fabric to the lining, it is necessary for the operator to pick up a rectangular piece of the lining, lay the shirt fabric piece on the lining, start the fold of the shirt fabric around the edge of the lining, and manually guide the lining and shirt fabric through the sewing machine to stitch the fabric and liner together. During this sewing operation, the operator must hold both the fabric and the lining against the pull of the sewing machine feed to maintain the fabrics aligned and to avoid bunching of the stitches, and it requires much experience on the part of the operator to exert just the right tension to prevent subsequent bunching of the stitches. This operation, which is repeated for each cuff, requires manual positioning, initial folding, guiding, tensioning, and subsequent cutting of the sewing machine thread to join the liner to a first piece of the cuff fabric. Since it is customary for one operator to perform this stitching operation only, there is fatique and boredom which causes the quality of the stitching to depend on the mood of the operator. Because different shirt fabrics require different tensioning during stitching (for example, a permanent press fabric can require more tensioning than a stretch-knit type fabric) it is not only necessary to initially train the operator but it is also necessary to train the operator to perform this single operation with different fabrics. As a result of the many variables involved in performing this operation, it is difficult to consistently obtain good quality stitching of the first piece of cuff fabric to the lining.

SUMMARY OF THE INVENTION

In accordance with the invention there is provided a method and apparatus for continuously sewing a first piece of cuff fabric to a lining with a minimum of manual intervention so even a relatively inexperienced operator can produce well sewn fabric-lining units several times faster than an experienced operator can produce the units with prior techniques. The useful life of the sewing machine used for stitching is also extended substantially because the machine sews continuously rather than intermittently, as in the past. Fatigue of the operator is substantially reduced because it is merely necessary for the operator to position the shirt fabric relative to the lining, the lining being fed automatically, and the folding being accomplished automatically while the required stitching is performed.

In accordance with the invention, the lining is in the form of a continuous strip which is fed at a predetermined constant rate through a fabric positioning station where a precut piece of shirt fabric is placed on the moving lining. Accurate positioning of the shirt fabric piece on the moving lining is assured by guides at the fabric receiving station. The lining acts as a conveyor to convey the shirt fabric piece through a folding station where the shirt fabric is folded under the side edge of the moving lining, is automatically smoothed and tensioned, and is fed and guided through a continuously operating sewing machine with the folded edge accurately positioned relative to the sewing head. Additional pieces of shirt fabric are placed on the moving lining at the positioning station in sequence so there is a slight space between each shirt fabric piece on the continuously moving lining. The individual pieces of shirt fabric can be manually placed on the lining at the positioning station, or alternatively, can be automatically placed on the lining by a suitable fabric feed mechanism.

The shirt fabric is folded around the side edge of the lining by a hem folder device as the lining strip and shirt fabric move toward the sewing head. In contrast to the narrow feed mechanism used on conventional sewing machines, a knurled feed roller having a width greater than the width of the lining strip and which is downstream of the sewing head grips and pulls both the lining strip and the shirt fabric through the sewing machine by the same intermittent action as the normal sewing machine feed mechanism. The feed roller arrangement includes a spring urged idler roller which presses the lining strip and fabric against a knurled feed roller as the strip and fabric pass through the nip of the rollers. The feed roller is driven from the rocker feed mechanism of the sewing machine.

The lining, while still in the form of a continuous strip and with the shirt fabric pieces stitched to it in spaced relation extends to a cutting station where the lining material strip is automatically cut along a line in the space between the shirt fabric pieces. The feed at the cutting station is intermittent and preferably is normally slightly faster than the speed at which the lining is drawn through the sewing machine. A sensing arrangement including a dancer roller operates to automatically stop the feed mechanism for the cutter when there is insufficient lining fed from the sewing machine. This arrangement provides the additional advantage that the same cutter and cutter feed can be used regardless of the sewing speed of the sewing machine.

The cutting of the lining strip in the spaces between adjacent shirt fabric pieces is accomplished automatically by sensing when the space between the fabric pieces is beneath a cutter blade transverse to the length of the strip, stopping the lining strip while the space is in this position, and actuating the cutting blade to sever the liner along this space. The severed pieces are then removed from the cutter pneumatically and are stacked for subsequent processing. Inter-related controls for the cutter feed, cutter, and pneumatic conveyor assure that the liner strip always stops with its space between fabric pieces aligned with the cutter, that the reciprocating cutter blade is lifted before the cutter feed again starts, and that the severed piece is conveyed away before the cutter feed again starts. This arrangement prevents lifting of the fabric strip by the cutter blade on its return stroke and prevents jamming of the strip which could occur if a severed piece remains in the conveyor.

Advantageously, the drive motor for the cutter feed mechanism operates continuously and is coupled to the cutter feed by a slip clutch. A ratchet wheel between the slip clutch and a drive roller stops the drive roller when a pawl is moved into engagement with the ractchet wheel to block the wheel against rotation in response to sensing the space between shirt fabric pieces. This arrangement provides an inexpensive yet reliable mechanism for assuring that the space between sewn fabric pieces on the lining strip is aligned with the cutter and that the lining strip is stopped when the cutter is actuated to sever the lining.

Correspondingly, an object of this invention is a method for forming a multi-ply fabric unit in which one of the plys of the fabric is a continuously moving strip, the second fabric ply is fed piece by piece onto the first ply, with the pieces in spaced relation, and a side edge of each second ply piece is folded under a side edge of the first ply en route to a machine where the plys are stitched together.

Another object is a method of forming a multi-ply unit as a first step in the manufacture of a shirt cuff, in which shirt fabric pieces are placed on a continuously moving lining strip in end to end spaced apart relation, a side edge of the shirt fabric is automatically folded under a side edge of the lining, and the stitching of the shirt fabric to the lining is continuously done by a continuously operating sewing machine.

Another object is a method of making a shirt cuff in which a first step in the manufacture of the cuff, namely, that of sewing a first piece of shirt fabric to a lining is accomplished continuously, by continuously moving the lining through a continuously stitching sewing machine, by depositing precut shirt fabric pieces on the continuously moving lining in closely adjacent spaced apart end to end relation to each other, and by automatically folding an edge of the shirt fabric around an edge of the lining immediately prior to stitching the folded edge of the shirt fabric to the lining.

Another object is an apparatus for forming a multi-ply sheet material unit as an intermediate step in the manufacture of the unit, and which apparatus includes, a stitching machine, a feeder driven by the stitching machine for drawing a continuous strip of material through the machine, a fabric piece receiving station for receiving fabric pieces in aligned end to end relation on the continuous strip, and a folder between the fabric receiving station and the stitching machine for folding an edge of each fabric piece around the edge of the continuous strip prior to stitching.

Another object is a unique apparatus for forming multi-ply fabric units which includes a feed mechanism for feeding a continuous fabric strip through a continuously operating stitching machine, a fabric piece receiving station for receiving fabric pieces in aligned end to end relation on the continuous fabric strip, a folder between the stitching machine and the fabric feeding station, and a hold down arrangement for holding the fabric pieces against the moving strip so the fabric pieces move with the strip through the folder and the stitching machine.

Another object is an apparatus for forming multi-ply sheet material units which includes a feeder for feeding a continuous strip of material through a stitching machine, a folder for folding around the strip the side edge of individual pieces of material positioned on the strip in spaced apart end to end relation, so the individual pieces are sequentially folded and stitched to the strip and a separately driven cutter including a cutter feed mechanism and sensing control for stopping the stitched strip with the space between pieces in aligned relation with a reciprocating cutter that cuts the strip while the strip is stationary.

A further object is an apparatus for severing a continuous strip of material having individual pieces stitched thereto in spaced apart end to end relation in which a sensing device senses the location of the space between the pieces, arrests a cutter feed mechanism to stop the feed when the space is aligned with a cutter, maintains the feed arrested until the cutter cuts the strip and retracts, and prevents resumption of operation of the feed mechanism until the severed piece is removed from the path of travel of the remaining strip.

A further object is a unique fabric feed mechanism in which a continuously operating motor drives feed rollers via a slip clutch, a toothed ratchet wheel is in the drive train between a feed roller and a slip clutch, and a pawl is arranged to be moved into the path of travel of the ratchet wheel to stop the fabric feed with the fabric pieces on the strip at a desired location while the drive motor operates continuously.

A further object is a unique cutter and control system in which a sensing device senses the location where a fabric strip is to be cut, a fabric feeder is stopped with the location of the cut aligned with a cutter, the cutter is operated in response to the position of a blocking element which stops operation of the cutter, the cutter severs the strip at the desired location, a conveyor conveys the severed piece out of the path of travel of the strip, and the feed mechanism is prevented from again feeding of the strip until the cutter is clear of the strip and the severed piece is removed from the path of travel of the strip.

A further object is an apparatus for cutting a continuous strip of material in the space between fabric pieces sewn thereon in spaced apart relation, in which the fabric pieces are sewn by a mechanism which stitches at a rate slower than a cutter feed mechanism in which the cutting mechanism operates intermittently to sever all the stitched material supplied by the sewing head so there is no overflow of the material, and in which the cutter feed stops automatically when the supply of stitched material from the sewing head is insufficent.

A further object is a method of feeding and severing a supple fabric strip which has pieces of fabric sewn thereon in spaced apart end to end relation in which the fabric strip is fed from a location upstream of the cutter, feeding is stopped in response to sensing alignment between the space between fabric pieces and the cutter, and in which feeding is not resumed until the fabric is cut, the cutter is retracted and the severed piece is conveyed away from the path of travel of the strip.

A further object is a unique feed mechanism for a sewing machine in which the feed mechanism includes feed rollers at least as wide as a strip of fabric to be sewn, and the rollers are driven from an oscillating feed drive mechanism of the sewing machine.

A still further object is an apparatus and method in accordance with the preceding objects in which the apparatus is relatively inexpensive, the method performed by the apparatus provides for simplicity and reliability, and the method and apparatus permits rapid accurate production of shirt cuffs by relatively inexperienced personnel.

Numerous other features, objects and advantages will become apparent with reference to the accompanying drawings which form a part of this specification.

DESCRIPTION OF THE DRAWINGS

FIG. 4 is an enlarged view in plan of the hem folder, presser foot shoe, and feed mechanism at the sewing machine;

FIG. 5 is an enlarged view in section of the hem folder taken along line 5—5 of FIG. 4;

FIG. 6 is a partial view in section taken along line 6—6 of FIG. 4 and showing the fabric feed mechanism as viewed from the downstream side of the mechanism;

FIG. 7 is a side view in elevation of the mechanism of FIG. 6;

FIG. 8 is an enlarged view of the cutter feed mechanism taken along line 8—8 of FIG. 3;

FIG. 9 is an enlarged view taken along line 9—9 of FIG. 8 showing a ratchet wheel and pawl for controlling the cutter feed mechanism.

DESCRIPTION OF THE PREFERRED EMBODIMENT

Figure 1:
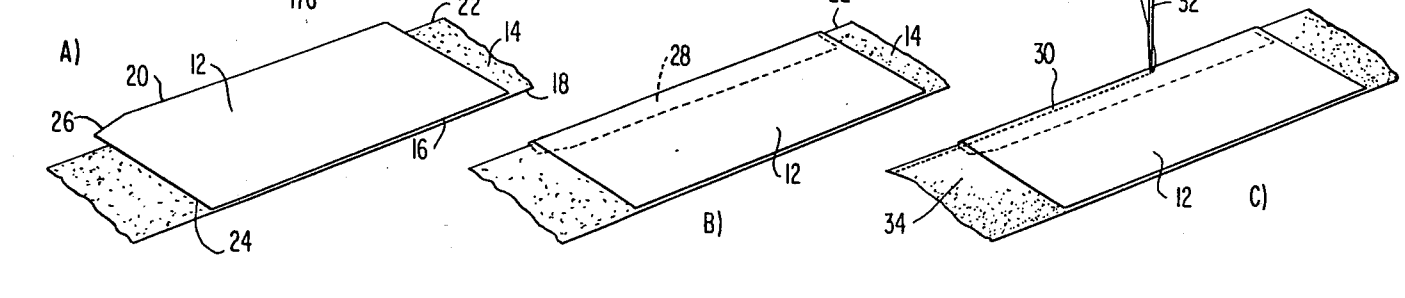
FIGS. 1A, B, and C show pictorially the steps of placing a piece of shirt fabric on a lining strip, folding a side of the shirt fabric around a side edge of the lining strip, and continuously stitching the lining strip and the shirt fabric to the lining strip, in accordance with this invention.

FIG. 1A shows an initial step, according to this invention, for forming a multi-ply sewn product such as a shirt cuff. Initially, a precut rectangular piece 12 of shirt fabric is placed on a continuous strip 14 of lining material. One side edge 16 of fabric piece 12 is aligned with side edge 18 of lining strip 14. Shirt fabric piece 12 is wider than strip 14 so its other edge 20 extends beyond side edge 22 of the lining strip. Adjacent the juncture of side edge 20 with front edge 24 of fabric piece 12, the side edge is cut at a slight angle 26 to facilitate folding, as will soon be described.

FIG. 1B shows the overhanging portion 28 of shirt fabric piece 12 folded around side edge 22 of lining strip 14 and underneath the lining strip.

While the portion 28 of shirt fabric piece 12 is held against the underside of lining strip 14, the lining strip and fabric 12 are fed through a continuously operating sewing machine to form stitches 30 (FIG. 1C) parallel to side edge 22 of the lining strip. Stitches 30 extend through and join the upper and lower portions of the shirt fabric piece 12 to lining strip 14. In accordance with this invention the needle 32 of the sewing machine sews continuously even along the portion 34 of the lining strip which is not covered by fabric piece 12.

The apparatus and manner in which multi-ply shirt cuff units are produced in accordance with this invention will now be explained with reference to FIGS. 2 and 3. Apparatus 40 includes a continuous supply such as a roll 42 of lining strip 14. The lining strip is continuously fed over a loading station 44 where shirt fabric pieces 12 are fed one by one onto the strip from a feed hopper or platform 46 located at the upstream end of the loading station. The apparatus also includes a folding station 48 where over-hanging portions 28 of the shirt fabric is folded under the side edge of the lining strip, a sewing machine 50 where the shirt fabric piece is stitched to the lining strip, a feed station 52 which pulls the lining strip and fabric through the sewing machine, and a cutting, conveying, and stacking station 54 where the lining strip is severed in spaces between the shirt fabric pieces stitched to the lining strip. Between feed station 52 and cut off station 54 is a control mechanism 56 which controls the feed of the sewn strip in accordance with the supply from the sewing machine.

A cutter feed mechanism 58 downstream of control arrangement 56 is operated to stop the sewn strip when the space between the shirt fabric pieces 12 is algined with cutter 59, so the cutter severs the strip along a line between the fabric pieces.

Initially, a sufficient length of lining strip is drawn from roll 42 to extend over loading station 44, through hem folder 48, sewing machine 50, feed mechanism 52, sensing mechanism 56 and cutter feed mechanism 58. The operator then starts the apparatus to cause the sewing machine 50 to stitch and the feed mechanism 52 to feed the strip 14 from roll 42. The operator places fabric pieces 12 one by one onto the moving strip at loading station 44 so there is a space between the ends of adjacent fabric pieces on the strip.

Loading station 44 takes the form of a flat plstform 62 (FIGS. 3 and 4) of a length greater than the length of fabric piece 12 and of a width greater than the width of the fabric piece. At one side of platform 62 is a fixed guide fence 64 which engages side edge 18 of lining strip 14 to maintain the lining strip in transverse alignment relative to sewing machine 50. At the other side of platform 62 is a guide fence 66 parallel to guide fence 64 and which is connected to platform 62 by screws 68 which pass through transverse slots 67 in the guide fense so, guide fence 66 can be laterally adjusted to accomodate shirt fabric and lining strips of different widths. Guide fence 66 is adjusted initially so there is only a slight clearance between side edge 20 of fabric piece 12 and fence 66, when side edge 16 of the fabric piece is against fence 64. This arrangement provides for rapid placement of fabric piece 12 in an aligned position on the lining strip 14 moving over platform 62.

With apparatus 40 in operation, lining strip 14 is pulled by sewing machine feed mechanism 52 and a shirt fabric piece 12 on the lining strip moves with the lining strip along the smooth platform 62 to folding station 48. As shown at FIG. 4, there is a hold down foot 72 beneath which lining strip and shirt fabric piece 12 are drawn by the feed mechanism. The hold down foot is elongated in the direction of travel of lining strip 14 and includes a flat hold down portion 74 parallel to platform 62 and which is joined to an upwardly inclined supporting portion 76 at a smooth bend 78. Flat hold down portion 74 is narrower than lining strip 14, as shown at FIG. 3, and extends the length of the folding station. Supporting portion 76 is pivotally connected to a transversely extending support rod 80 by bearing sleeves 82. Stop collars 84 at each side of the bearing sleeves prevent lateral movement of the hold down foot and mount the foot with its side edge 83 parallel with and closely adjacent fence 64. Bearings 82 pivotally mount hold down foot 72 to swing freely so its hold down action is a function of its weight. The inclined support portion 76 and smooth bend 78 guide the shirt fabric piece under the hold down portion 74 which then presses the shirt fabric pieces against the lining strip with sufficient pressure to prevent relative movement of the fabric piece and lining strip at the folding station.

At the folding station there is a floor 86 which is coplanar with and forms a continuation of loading station platform 62. A hem folder 88 secured to the apparatus by a transversely extending arm 90 adjustably secured to a support bar 92 by screws 94 which pass through a slot 96 in the arm so hem folder 88 can be moved toward and away from side edge 98 of floor 86. The side edge of floor 86 is inclined inwardly from the end of fence 66 to provide an inclined edge 100 which smoothly merges with side edge 98, the side edge 98 being essentially parallel to fence 64.

As shown at FIGS. 4 and 5 hem folder 88 curves around side edge 98 of floor 86 in spaced relation to a top surface 102 and a bottom surface 104 of the floor and presents a smoothly curved interior guide surface 106 which engages the beveled edge 26 and side edge 20 of fabric 12 to fold the overhanging portion 28 of the fabric around edge 98 of the floor and correspondingly, around the side edge of the lining strip 14 moving over floor 86. As shown at FIGS. 4 and 5, interior guide surface 106 converges from adjacent its inlet 107 where it first engages the side edge of the shirt fabric piece to its outlet 108 where the lining strip and shirt fabric piece leave the folder. The distance between interior surface 106 and fence 64 at inlet 107 is only slightly less than the width of shirt fabric piece 12, whereas the distance between the surface 106 and fence 64 adjacent outlet 108 is only slightly greater than the width of lining strip 14. A leading edge 109 of hem folder 88 is cut at an angle to gradually engage and roll the side edge of a shirt fabric piece around side edge 98 of hem folder floor 86. These features assure that the overhanging side portion 28 of a shirt fabric piece 12 will be smoothly folded under the edge 98 of floor 86 and around the lining strip moving over this floor.

Closely adjacent outlet 108 of folder 88 is a unique presser foot 112 which is supported by the presser foot support rod mechanism 113 of sewing machine 50, the conventional narrow presser foot having been removed. Presser foot 112 takes the form of a plate with a width which is slightly greater than lining strip 14 and shirt fabric piece 12 with its overhanging edge 28 folded under the lining strip. A sloping inlet guide portion 114 guides the folded leading edge of the shirt fabric piece under foot 112 which holds the piece in its folded position as it is drawn beneath needle 32 (FIGS. 4 and 7). It will be seen at FIG. 4 that sewing machine table 116 extends beneath the outlet 108 of folder 88 to prevent folded portion 28 of the fabric from unfolding before it passes under presser foot 112 and is stitched by needle 32. Hold down foot 112 has an opening 118 through which needle 32 reciprocates during stitching. The hold down plate also prevents the fabric from lifting as the needle is withdrawn from opening 118 during stitching.

The operation of sewing machine 50 is conventional save that feed mechanism 52 is used in lieu of the conventional feed mechanism of the sewing machine. Feed mechanism 52 does, however, advance the liner strip and fabric intermittently and each advance is equal to the length of a stitch. Such advancing motion occurs in the usual timed relation to the position of the needle so the fabric is advanced while the needle is withdrawn from the fabric and the fabric remains motionless so the needle extends through the fabric.

As shown in FIGS. 4, 6 and 7, feed mechanism 52 is mounted on frame 120 of the sewing machine at a location somewhat downstream of needle 32 in the direction of feed of fabric through the machine. The feed mechanism includes a knurled drive roller 122 fixed to a shaft 124 which has mounted for rotation in fixed spaced apart relation bearing blocks 126 and 128. In a space between bearing block 128 and a side face of drive roller 122 is a drive arm 132 that is connected to shaft 124 by a one-way ball type clutch which turns roller 122 when the arm is moved counterclockwise, as the apparatus is viewed in FIG. 7, but which permits the arm to be moved clockwise without rotating drive roller 122. A clutch block 134 is mounted beside bearing block 128 and a second one-way ball clutch block 134 is connected to shaft 124 to permit drive roller 122 to rotate in a counterclockwise direction but prevents the roller from rotating in a clockwise direction, as viewed at FIG. 7. The clutch in clutch block 134 prevents drive roller 122 from being rotated in a reverse direction by the tension in the lining strip, when drive arm 132 moves clockwise.

Above drive roller 122 is an idler roller 136 with a soft surface which presses the lining strip and fabric against the drive roller as a result of the action of tension spring 138. Idler roller 136 is mounted for rotation in a support head 140 which is connected to a support arm 142 by a bolt or pin 148 for pivotal movement about an axis parallel to the direction of feed of the lining strip. Pin 148 makes idler roller 136 self-aligning so it will compensate for variations in thickness of the material fed between the nip of the rollers while providing an even gripping and driving action. The inner end of arm 148 is pivotally mounted by a pin or bolt 150 to a support arm 152. A lever 154 pivoted to frame 120 by a bolt 156 has a pin 158 which extends beneath arm 142 to enable lifting arm 142 and idler roller 136 upwardly by pivoting lever 154 in a counterclockwise direction as viewed at FIG. 6.

An additional advantage of the floating type idler roller 136 is its ability to tilt slightly while maintaining a substantially constant pressure on the fabric across the entire width of the fabric. Advantageously, drive roller 122 and idler roller 136 each have a width greater than the fabric which is drawn between the nip of the rollers. This provides for maintaining a constant even pull across the width of the liner strip and shirt fabric piece and prevents puckering, distortion, and creep of the lining strip relative to the fabric piece.

Drive arm 132 is oscillated by a rod 162 having one end pivotally connected to arm 132 by a bolt 164, and having its other end (not shown) connected to and driven by the conventional oscillating drive mechanism of the sewing machine fabric feeder. Such mechanism of the sewing machine (not shown) conventionally takes the form of an oscillating crank arm which oscillates in synchronism with the up and down motion of the needle to maintain the fabric stationary while the needle is in the fabric and to move the fabric one stitch length while the needle is withdrawn from the fabric. Rod 162 is connected to such a crank arm of the sewing machine and is reciprocated to drive roller 122 in the same synchronized manner as a result of the action of the one way clutches previously described. Drive arm 132 has a slot through which the end of rod 162 extends. This provides for adjusting the stitch length of the sewing machine by varying the effective length of drive arm 132. By loosening nut 164 and moving the arm upwardly the stitch length can be increased since the angular displacement of arm 132 and drive roller 122 is greater when the point of connection of the rod 162 with arm 132 is closer to the center of roller 122.

Hence, it is apparent that drive roller 122 advances lining strip 14 and fabric 12 in the same manner as the conventional feed mechanism of the sewing machine but does so by engaging the material across its entire width so shifting, puckering, and slipping of the layers of fabric relative to each other is completely avoided.

For purposes of explanation, the lining strip 14 with shirt fabric pieces 12 stitched to it will subsequently be referred to as the stitched strip 170. The stitched strip 170 from feed mechanism 52 passes through control mechanism 56 and then to cutter feed mechanism 58 which feeds the strip to cutter head 54 and into a pneumatic conveyor.

Figure 3:
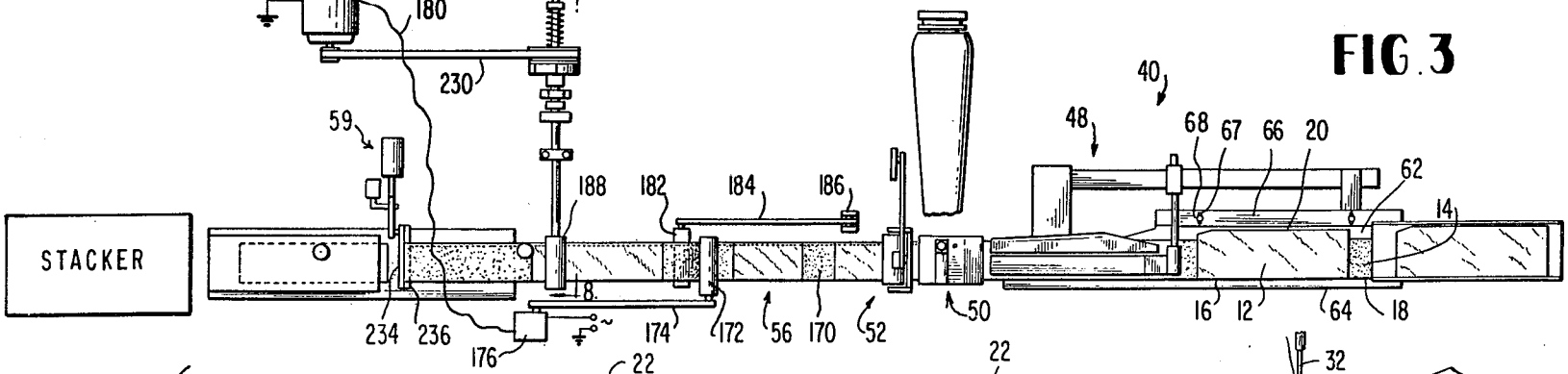
FIG. 3 is a plan view of the apparatus of FIG. 2.

Control mechanism 56 includes a lower roller 172 connected to the end of an arm 174 which is pivotally mounted to an electric switch 176, which as shown at FIG. 3, is electrically connected by wire 180 to drive motor 178 of feed mechanism 58. There is also an upper roller 182 connected to an arm 184 which is secured to a support block 186. Stitched strip 170 passes under roller 172 and over roller 182 before it passes between the nip of cutter drive rollers 188 and 190 of cutter drive mechanism 58.

FIG. 8 shows the cutter drive mechanism 58 in greater detail. As shown at FIG. 8, cutter drive rolls 188 and 190 are secured to the ends of vertically spaced apart shafts 192 and 194 respectively which are rotatably mounted in a bearing block 196 secured to a support plate 198. Secured to shaft 192 is a gear 200 and secured to shaft 194 is a gear 202 which meshes with gear 200. Also secured to shaft 194 is a drive gear 204 which meshes with a drive gear 206 freely rotatable relative to shaft 192 and which is secured to and driven by a drive wheel 208. Drive wheel 208 is driven by a driven drive pulley 210 via a slip clutch assembly including a clutch disc 212 and a compression spring 214 which force pulley 210 toward drive wheel 208. By virtue of adjustable collar 216, the torque transmitted to rollers 188 and 190 can be regulated. The pressure at the nip of rollers 188 and 190 can be adjusted by manipulating adjusting wing nut 218 to press the shaft 192 toward shaft 194.

As shown at FIG. 9, drive wheel 208 takes the form of a ratchet wheel having four equally spaced teeth 220 each of which has a flat front face in a radial plane. If desired, the ratchet wheel can have more or less than four equally spaced teeth. The several teeth 220 are cut so the rear face 222 is arcuate and extends from the root of one tooth to the crest of an adjacent leading tooth, in the direction of rotation of the drive wheel. Cooperating with wheel 208 is a pawl 224 which provides for selectively stopping the rotation of drive wheel 208 when the pawl is moved into the position shown at FIG. 9 where its tip 226 engages the flat face 228 of a tooth. When pawl 224 is in this position, rotation of drive wheel 208 and drive rollers 188 and 190 is arrested and clutch disc 212 slips while drive motor 178 (FIG. 3) continues to drive pulley 210 via drive belt 230. Pawl 224 is moved into engagement with drive wheel 208 in response to the operation of a cutter feed control which will soon be described.

Figure 2:
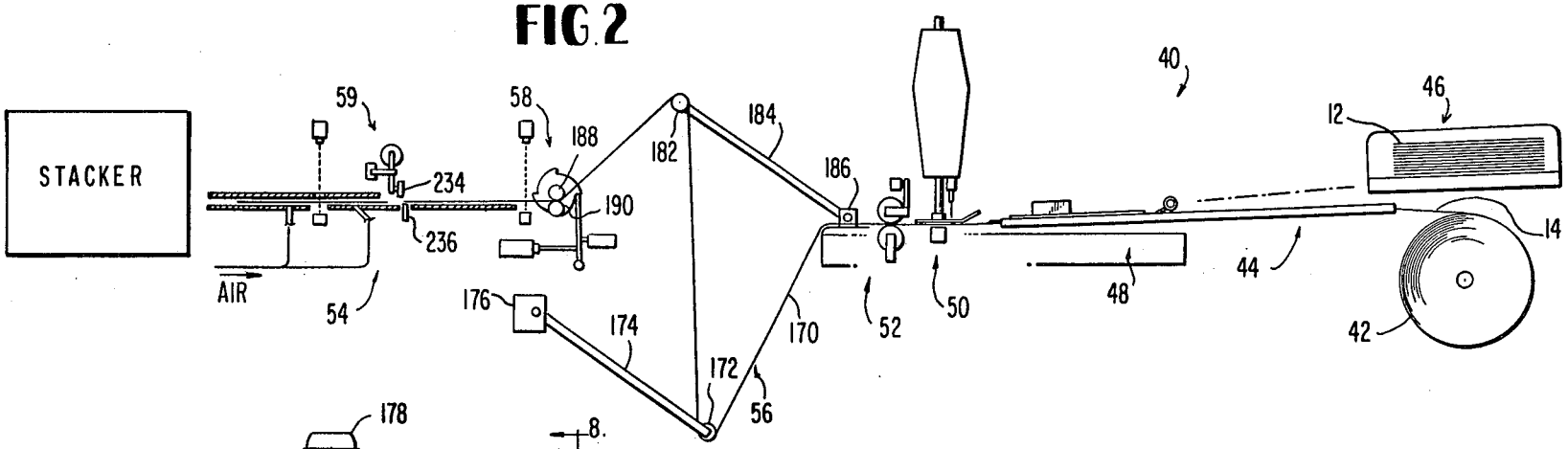
FIG. 2 is a side view in elevation schematically showing the apparatus of the invention and with which the method of the invention is practiced.
Figure 10:
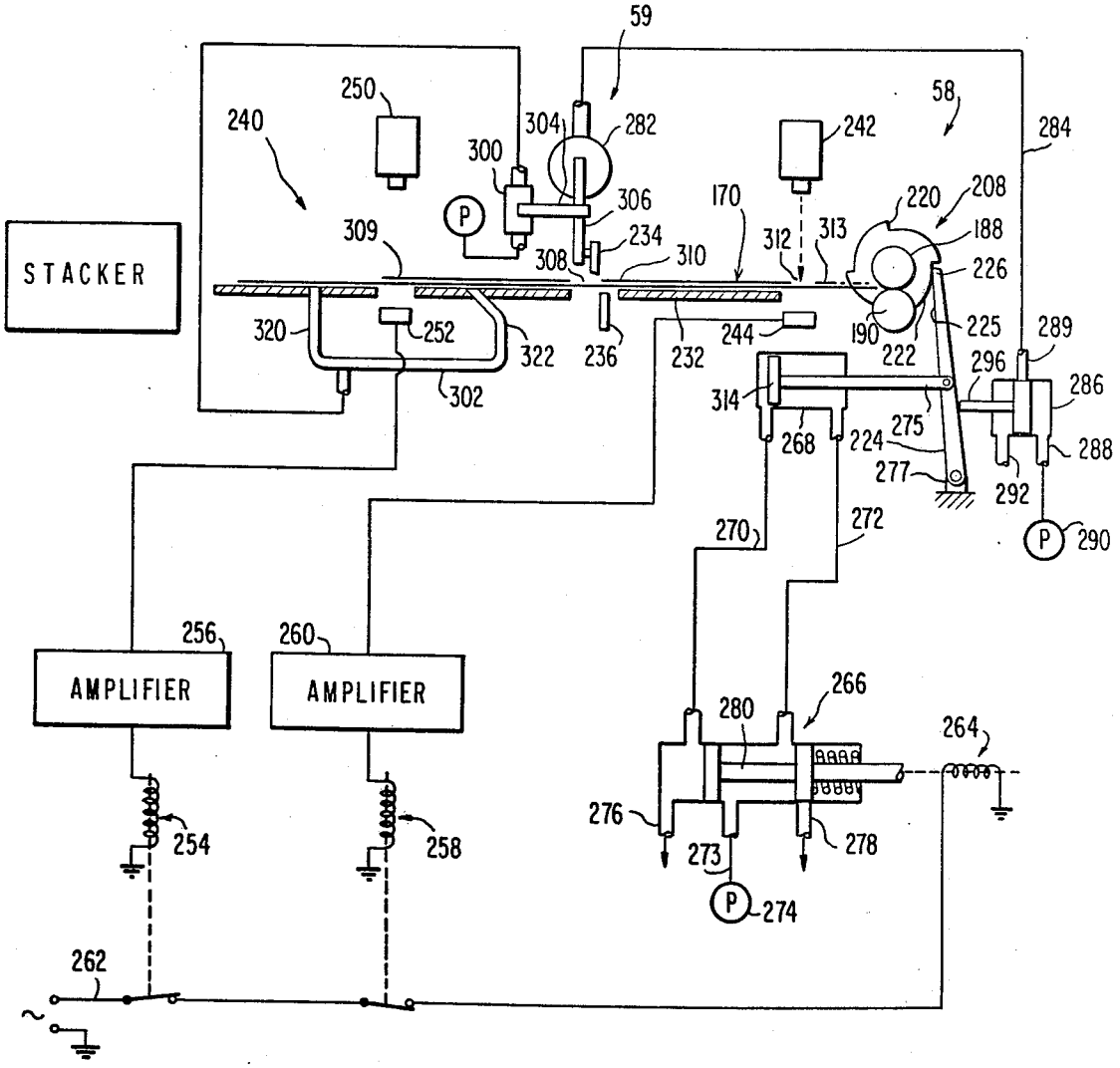
FIG. 10 is a diagramatic view of the layout of and control arrangement for the cutter feed mechanism, cutter, and conveyor.

As shown at FIGS. 2, 3, and 10, strip 170 is fed by rollers 188 and 190 across a table 232, which is discontinuous at the location of transversely extending cutter blades 234 and 236 of an air operated cutter 59 and into a pneumatically operated cut strip conveyor 240 which is immediately beyond cutter 59.

Between cutter drive mechanism 58 and table 232 is a light source 242 which directs light toward a sensing photocell 244. Light source and photocell 244 are located a distance from cutter blades 234, 236 which is slightly greater than the length of a piece of shirt fabric 12. Since the lining 14 of stitched strip 170 is a loose weave material, the lining has light transmitting characteristics such that when the space between two shirt fabric pieces 12 is immediately beneath light source 242, photocell 244 receives some of the light passing through the lining.

At conveyor 240 there is a light source 250 and a photocell 252 which are located downstream of the blades of cutter 238 a distance slightly less than the length of a piece of shirt fabric 12. A cover plate 253 of the conveyor can be transparent plastic so light can pass from light source 250 to photocell 252. Fluidic, air or other type sensors can also be used to detect variations in thickness or weave of lining and/or fabric instead of the light-photocell arrangement.

As shown at FIG. 10, the control for cutter 238 includes a first relay 254 connected to an amplifier 256 controlled by photocell 252. There is a second relay 258 connected to an amplifier 260 controlled by photocell 244. The contacts of relays 254 and 258 are in series with a power supply line 262 connected to a solenoid coil 264 which operates a four way control valve 266. Control valve 266 is connected to power cylinder 268 by pneumatic lines 270 and 272, and valve 266 receives air pressure at line 273 from pressure source 274. Valve 266 also has vent ports 276 and 278 which vent one end of cylinder 268 when valve spool 280 is shifted to a position to apply pressure from source 274 to the other end of the cylinder. Piston rod 275 of cylinder 268 is connected to pawl 224 to swing the pawl about its pivot 277 when cylinder 268 is actuated.

The blades of cutter 59 are operated by a pneumatic cylinder 282. Cylinder 282 is of the spring return type which is actuated to force blade 234 downwardly when air flows into the head end of the cylinder via flow line 284. Flow line 284 is connected to air control valve 286 and receives pressure air from source 290 when valve inlet port 288 communicates with valve port 289. Valve 286 also has a vent port 292 which vents air from the cylinder 282 and line 284 when port 292 communicates with line 289. An actuator stem 296 of valve 286 engages the side of pawl 224 and is moved by the pawl.

Mounted adjacent cylinder 238 is a conveyor control valve 300 which is normally closed so no air flows through the air piping 302 of pneumatic conveyor 240. An actuating lever 304 of valve 300 is in the path of travel of cutter operating bar 306, and valve 300 is opened when the piston of cylinder 282 is fully extended and blade 234 is at the bottom of its cutting stroke.

Cutter feed mechanism 58 pushes the stitched strip 170 across table 132 and into pneumatic conveyor 240. The feed mechanism is operated to stop the stitched strip when a space 308 between shirt fabric pieces 309 and 310 is algined with cutter 59 by sensing the space 312 between the shirt fabric pieces 310 and 313. Correspondingly, it is apparent that stopping strip 170 so cutter 59 can cut in the space 308 between end fabric piece 309 and second-from-the-end fabric piece 310 is accomplished by sensing the location of the space between the second-from-the-end fabric piece 310 and the third-from-the-end fabric piece 313. It is the position of the trailing end of a shirt fabric piece which controls where a cut is made. Even though the length of each fabric piece is not always the same, these pieces are approximately the same length and the cut is always made at the space between pieces despite variations in the length of the pieces or the spacing between the pieces. The manner in which this is accomplihsed by the control apparatus of FIG. 10 will now be explained.

The sensing and control apparatus of FIG. 10 shows the various parts in their respective positions an instant before cutter 59 is actuated to sever the stitched strip 170 at the space 308. As shown at FIG. 10, the strip 170 has reached the position in which space 312 between fabric pieces 310 and 313 is beneath the light beam emanating from light source 242. The light received by photocell 244 operated amplifier 260 to energize relay 258 so its contacts are closed, as shown. A portion of shirt fabric 309 within pnenumatic conveyor 240 blocks the path of travel of light from light source 250 so photocell 252 remains dark, amplifier 256 is inactive, and relay 254 is unenergized so its normally closed contacts remain closed. With the contacts of both relays 254 and 258 closed, electricity from line 262 has energized solenoid coil 264 and shifted Valve spool 280 of valve 266 to the position shown. Vavle 266 caused pressurized air from pressure source 274 to enter the rod end of cylinder 268 via line 272 and pull piston rod 275 and pawl 224 to the left. In this position of pawl 224, its side edge 225 rests against the rear surface 222 of a ratchet tooth of the wheel 208. Valve 286 is about to open so air under pressure from source 290 will flow through port 289 to operate cutter 59, but the valve 286 will not open until side edge 225 of the pawl reaches its maximum counterclockwise position, and that cannot occur until curved rear face 222 rotates to a position where edge 225 is at the base of a tooth 220 and tip 226 engages a tooth 220. Hence, the curved rear face 222 functions as a cam to prevent pawl 224 from moving to its fullest counterclockwise position and opening valve 286 until wheel 208 rotates to a position where the tip engages tooth 220. FIG. 9 shows the pawl in its fully seated position in which the pawl has moved a sufficient distance to the left to open valve 286 and actuate cutter 59.

Hence, at the instant tip 226 engages the front surface of a tooth 220, two things occur substantially simultaneously. First, drive wheel 208 is blocked by the pawl 224 to stop feed rollers 188, 190 so strip 170 is stopped, and pulley 10, continuously driven by motor 178, simply slips by virtue of the action of clutch face 212 and spring 214. Second, valve 286 opens so pressurized air from souce 290 now communicates with port 289 and line 284 to operate cutter 59 and drive the cutter blade 234 downwardly to sever the fabric. By virtue of the coaction of wheel 208, pawl 224, and valve 286 it is assured that fabric strip 170 is stopped when the cutter is operated.

Regardless of the rotational position of ratchet wheel 208 when cylinder 268 is actuated to swing pawl 224 toward the blocking position shown at FIG. 10, strip 170 will move only a small distance, less than the space between fabric pieces, before the tip 226 of the pawl 224 fully seats against a tooth 220 of the wheel to stop the feed of the sewn strip and operate the cutter. Of course, if the rotational position of wheel 208, at the time pawl 224 is actuated, is such that the pawl seats at the base of a tooth 220, the valve 286 will open immediately to actuate the cutter 59.

The final forward motion of blade arm 306 which drives cutter blade 234 downwardly opens valve 300 by engaging its actuator 304 to admit air to the piping 302 of conveyor 240. Air flowing through pipe 320 lifts the now severed stitched piece 309 while air flowing through pipe 322 impinges on the piece at an angle and conveys it to the left into the stacker. So long as the fabric piece 309 blocks the light path between light source 250 and photocell 252, the contacts of relays 254 and 256 remain closed, cutter blade 234 remains extended, and pawl 224 prevents rotation of drive wheel 208. When the now cut fabric piece 309 is conveyed out of the path of light from light source 250 to photocell 252, photocell 252 opens its contacts. This deenergizes solenoid coil 264 causing spool 280 of valve 266 to shift to the left thereby connecting line 272 to vent 278 and pressure source 274 to line 270 to shift piston 314 and pawl 224 to the right so the pawl no longer blocks wheel 208 and the cutter feed rollers resume rotation. As pawl 224 moves to the right, actuator stem 296 of valve 286 also shifts to the right to connect line 284 to vent 292 thereby causing the spring biased cylinder 236 to return to its initial position in which blade 234 is lifted. Simultaneously, as arm 306 of the cutter lifts blade 234, actuator 304 is released and valve 300 closes, discontinuing the flow of air through piping 302 of conveyor 240.

With strip 170 again moving, shirt fabric again moves into the path of travel of light from light source 242 to photocell 244. Hence, the contacts of relay 258 are open. Since there is no fabric in the path of travel of light from light source 250 to photocell 252, the contacts of relay 254 are open. Light source 250 and phtotcell 252 are so positioned that the end piece of fabric to be cut will move into the path of travel of light from light source 250 a short time before a space 312 between fabric pieces permits light from source 242 to fall on photocell 244. Since a cutting cycle starts only when the contacts of both relays 254 and 258 are closed, failure of the next end of strip 170 to feed properly into the conveyor and beneath light source 250 will maintain relay 254 energized so its contacts are open and a cutting cycle will not be initiated. Since the failure of an end piece of fabric to feed into conveyor 240 will normally cause jamming which lifts strip 170 from table 232, the photocells 252 and 244 and the relays 254 and 258 controlled by these photocells assure that cutter 59 will not cut in the event of a jamming malfunction. Normally, however, the first stage of such a malfunction is the failure of the cut end piece to feed properly from pneumatic conveyor 240 with the result that the end edge of the strip would be blocked by the cut piece still in the pneumatic conveyor. However, since the feed rollers cannot resume rotation until the pneumatic conveyor is clear and there is no fabric in the path of travel from light source 250 to photocell 252, the cutter feed and cutter simply remain inactive in the event of such a malfunction.

Advantageously, motor 178 drives cutter drive 58 at a rate somewhat faster than sewing machine 50 and feed mechanism 52 feed and stitch the lining strip to the shirt fabric. This provides time for stopping the fabric, severing it, and conveying the severed piece to the stacker without accumulating excess material from sewing machine 50. In the event that the supply of stitched strip 170 from feed mechanism 52 is insufficient, the faster feed of the cutter feed mechanism 58 will cause control roller 172 to be lifted thereby lifting arm 174. When arm 174 reaches a predetermined position (for example, slightly above horizontal) switch 176 is actuated to shut off motor 178. When the supply of stitched strip 170 is again sufficient for roller 172 to lower to the position shown at FIG. 2, the motor is again energized and the cutter feed continues its feeding operation.

OPERATION

In operation, lining strip 14 is first threaded through fabric piece receiving station 44, folding station 42, sewing machine 50 and feed mechanism 52. After a sufficient numer of fabric pieces 12 are stitched to the lining, the stitched strip 170 then available is fed under roller 172, over roller 182, and through cutter feed rollers 188 and 190.

Operation of the apparatus is as follows. Sewing machine 50 is started and allowed to run continuously. Feed mechanism 52 grips the strip and periodically feeds it in increments of a distance equal to the stitch length to be formed by needle 32 of sewing machine 50. Except for this periodic stitch feed, lining strip 14 is fed through the apparatus substantially continuously.

At fabric piece receiving station 44, shirt fabric pieces 12 are removed from hopper 46 and placed one by one between guide fences 62 and 66, onto the top surface of the lining 14 so the fabric pieces are spaced apart on the moving lining strip. Movement of the lining strip draws each fabric piece beneath the hold down foot 72 of folder 48 where hem folder 88 rolls the overhanging side edge 28 of the fabric under the side edge of lining strip 14. The folded edge is drawn under presser foot 112 which maintains the edge folded while it is stitched to the lining by needle 32 that reciprocates in opening 118 of the presser foot. At this state the strip 14 and fabric piece 12 have the configuration of FIG. 1C and have stitches 30 along one end which extend through both the fabric piece and the lining. The floating mounting for roller 136 coupled with the soft covering of the roller provides for pressing roller 136 against drive roller 122 so that the stitched strip is gripped uniformly across its entire width. Hold down foot 72 exerts a slight resisting force to tension the strip to assure proper stitching by sewing machine 50.

From feed mechanism 52 the stitched strip 170 is then drawn through and fed by the feed rollers 188 and 190 of cutter feed mechanism 58 which feeds the strip independently of feed mechanism 52. The strip is fed across platform 232 and into pneumatic conveyor 240 by these feed rollers. When, as shown at FIG. 10, the end fabric piece 309 reaches a location within conveyor 240 to interrupt light from light source 250 to photocell 252, relay 254 becomes unenergized so its contacts close. Then, when strip 170 moves slightly further, space 312 between fabric pieces 310 and 313 is between photocell 244 and its light source 242, and because lining 14 of the strip transmits light, photocell 244 actuates amplifier 260 to energize relay 258 and close its contacts. With the contacts of both relays 254 and 258 closed, valve 266 is shifted to the position shown at FIG. 10 to initiate a sequence of events including, swinging pawl 224 into the path of travel of a tooth 220 of wheel 208, stopping wheel 208 and the fabric strip 170 when a tooth 220 engages the pawl, simultaneously actuating cutter 59 to cause blade 234 to descend, and operating valve 300 to admit air to conveyor 240 in response to blade 234 reaching the bottom of its cutting stroke.

Air flowing through piping 302 of conveyor 240 conveys strip 309 to the stacker, and until strip 309 is conveyed out of the conveyor 240, strip 170 remains stationary since wheel 208 remains blocked by pawl 224. As soon as strip 209 is conveyed from conveyor 240, light is received by photocell 252, relay 254 is energized so its contacts open, valve 266 shifts to the left, cylinder 268 pivots pawl 224 to the right out of blocking engagement with a tooth 220, and valve 286 actuates cutter 59 to lift blade 234 before fabric strip 170 again begins to move. This sequence of operations is repeated to sever the end piece 309 from strip 170 in the space 308 between each of the fabric pieces.

While a preferred embodiment of a method and apparatus for automatically stitching fabric pieces to a strip and for cutting the strip in the space between fabric pieces have been shown and described, it is to be understood that numerous changes can be made without departing from the intended scope of this invention as defined in the appended claims.

What is claimed is:

1. A method of cutting a strip having individual pieces of clothing material secured thereto with the end edges of the pieces in predetermined spaced relation to each other along the length of the strip comprising, the steps of feeding the strip toward a cutter;

sensing the location of an end of a piece of clothing material on the strip;

stopping the strip in response to the sensing, with an end of the clothing piece in a predetermined position relative to the cutter;

maintaining the strip stopped while operating the cutter to cut the strip adjacent an end of the clothing piece;

conveying the severed piece of the strip out of the path of travel of the strip before resuming feeding of the strip.

2. A method according to claim 1 wherein the step of feeding the strip toward a cutter includes feeding the strip from a location upstream of the cutter; and the step of cutting the strip includes cutting the strip with a reciprocating cutter by advancing and retracting the cutter while the strip is stopped.

3. A method according to claim 1 wherein the clothing material pieces secured to the strip are secured in spaced relation to each other so their end edges are spaced apart;

said step of sensing the location of an end of a clothing material piece on the strip includes sensing the space between the end edges of the clothing material pieces on the strip; and said step of cutting the strip includes cutting the strip at the space between end edges of the clothing material on the strip.

4. A method according to claim 1 wherein said step of stopping the strip includes blocking a feed mechanism for the strip by engaging the feed mechanism with a stop element.

5. A method according to claim 1 wherein said step of conveying the severed piece of the strip out of the path of travel of the strip before resuming feeding of the strip includes feeding the strip to a pneumatic conveyor before performing the cutting step, sensing the presence of the strip in the conveyor, actuating the cutter in response to sensing the strip in the conveyor, and maintaining the strip stopped until the presence of the severed piece is no longer sensed.

6. A method according to claim 1 wherein the step of conveying the severed strip includes conveying the severed strip to a stacking device.

7. Apparatus for cutting a continuous flexible material strip having individual pieces of clothing material stitched thereto and with the ends of the pieces in predetermined spaced relation to each other comprising, in combination a cutter;

feed means for feeding the stitched strip to the cutter;

first sensing means for sensing an end edge of a clothing material piece;

blocking means responsive to the first sensing means for blocking the feed means to stop the feed of the strip with an edge of the strip aligned with the cutter;

cutter operating means responsive to the blocking means for actuating the cutter;

second sensing means for sensing the piece severed from the strip; and means responsive to said second sensing means for maintaining the strip feed blocked so long as the severed piece is in the path of travel of the strip.

8. Apparatus according to claim 7 wherein said cutter is a reciprocating cutter;

a means for removing the severed strip form the path of travel of the strip is responsive to a downward stroke of the cutter;

said blocking means is responsive to said first and second sensing means to unblock the feed means; and the cutter operating means returns the cutter to its initial position in response to operation of the blocking means to its unblocking condition.

9. Apparatus according to claim 7 wherein said feed means comprises a strip feed mechanism;

a motor continuously rotating to drive the feed mechanism, a slip clutch between the motor and the feed mechanism, said blocking means being between said slip clutch and said feed mechanism to stop the feed mechanism in response to actuation of the blocking means while allowing said motor to rotate said slip clutch.

10. Apparatus according to claim 9 wherein said blocking means includes a toothed wheel between the slip clutch and feed mechanism, and a pawl mounted for movement between a first position spaced from the wheel and a second position in the path of travel of the teeth of the wheel;

said blocking means including means for moving the pawl to the second position to engage the wheel and stop the feed mechanism of the strip.

11. Apparatus according to claim 9 wherein the apparatus further includes control means responsive to depletion of the supply of material available at the feed means for deactivating the motor means.

* * * * *